US006540272B2

(12) United States Patent
Spurr

(10) Patent No.: US 6,540,272 B2
(45) Date of Patent: Apr. 1, 2003

(54) LATCH MECHANISM

(75) Inventor: Nigel Victor Spurr, Hall Green (GB)

(73) Assignee: Meritor Light Vehicle Systems (UK) Limited, Birmingham (GB)

( * ) Notice: Subject to any disclaimer, the term of this patent is extended or adjusted under 35 U.S.C. 154(b) by 0 days.

(21) Appl. No.: 09/816,845

(22) Filed: Mar. 23, 2001

(65) Prior Publication Data

US 2001/0024040 A1 Sep. 27, 2001

(51) Int. Cl.[7] ..... E05C 3/06

(52) U.S. Cl. ..... 292/216; 292/DIG. 23; 292/DIG. 65; 292/DIG. 27

(58) Field of Search ..... 292/216, DIG. 65, 292/DIG. 23, DIG. 27; 70/264

(56) References Cited

U.S. PATENT DOCUMENTS

| | | | | | |
|---|---|---|---|---|---|
| 3,858,919 | A | * | 1/1975 | Kleefeld et al. | 292/216 |
| 4,005,887 | A | * | 2/1977 | Itakura | 292/216 |
| 5,154,460 | A | * | 10/1992 | Bartsch | 292/216 |
| 5,181,754 | A | * | 1/1993 | Shibata | 292/216 |
| 5,238,274 | A | | 8/1993 | Becker | |
| 5,653,484 | A | * | 8/1997 | Brackmann et al. | 292/216 |
| 5,676,003 | A | | 10/1997 | Ursel | |
| 5,803,515 | A | * | 9/1998 | Arabia et al. | 292/201 |
| 5,979,951 | A | | 11/1999 | Shimura | |
| 6,012,747 | A | * | 1/2000 | Takamura et al. | 292/210 |
| 6,059,327 | A | * | 5/2000 | Yoshikuwa | 292/216 |
| 6,126,212 | A | * | 10/2000 | Fujihara | 292/216 |
| 6,135,514 | A | * | 10/2000 | Kowalewski et al. | 292/216 |
| 6,247,732 | B1 | * | 6/2001 | Alton | 292/216 |
| 6,267,420 | B1 | * | 7/2001 | Miyagawa | 292/216 |
| 6,369,395 | B1 | * | 4/2002 | Roessler | 250/462.1 |

FOREIGN PATENT DOCUMENTS

| | | |
|---|---|---|
| DE | 199 61 247 A1 | 8/2000 |
| GB | 2337295 A | 11/1999 |
| GB | 2339 236 A | 1/2000 |

OTHER PUBLICATIONS

International Search Report, dated Jul. 31, 2001.

* cited by examiner

*Primary Examiner*—J. J. Swann
*Assistant Examiner*—Matthew E. Rodgers
(74) *Attorney, Agent, or Firm*—Carlson, Gaskey & Olds

(57) ABSTRACT

A latch mechanism includes a latch bolt having an open position for releasing a striker in use, and a closed position for retaining a striker in use, and a pawl having a retaining position for retaining the latch bolt in at least its closed position, and a release position for allowing the latch bolt to move between its open and closed positions, a release element having a rest position and an actuated position, a release link having an engaging position and a disengaged position, movement of the release element between its rest position and its activated position causing movement of the release link, movement of the release element from the rest position to the actuated position when the release link is in its engaging position causing the pawl to move to its release position, and movement of the release element from the rest position to the actuated position when the release link is in its disengaged position allowing the pawl to remain in its retaining position, and a locking member having a locked position, wherein the release link is held in its disengaged position and an unlocked position allowing the release link to move to its engaging position. A biasing member is provided which provides a bias action force and a bias reaction force, the action force acting to bias the release link towards its engaging position and the bias reaction force acting to bias the latch bolt towards its open position.

13 Claims, 2 Drawing Sheets

LATCH MECHANISM

BACKGROUND OF THE INVENTION

The present invention relates to a latch mechanism, in particular, although not exclusively, to a latch mechanism for use on a door of a motor vehicle.

It is known for an intended passenger of a locked motor vehicle to try to gain access to the motor vehicle by operating (lifting) an outer passenger door handle before all the doors of the motor vehicle are unlocked by an intended driver with a key actuating a central door locking system. With some models of motor vehicle, the action the intended passenger takes in operating the door handle prevents the latch mechanism of that door from being unlocked as the other doors are unlocked by the central door locking system.

Recently it has been known to provide a latch mechanism which when an associated outside door handle is lifted whilst a central door locking system unlocks the other doors of the motor vehicle and the outside door handle is subsequently released, the latch mechanism automatically moves to an unlocked condition. Such unlocking is known as "panic unlocking".

Latch mechanisms which provide for panic unlocking included additional components when compared to latch mechanisms which do not have such a panic unlocking facility.

SUMMARY OF THE INVENTION

An aim of the invention is to provide a "panic unlocking" type of latch mechanism having a reduced number of parts.

According to a first aspect of the invention there is provided a latch mechanism including a latch bolt having an open position for releasing a striker in use, and a closed position for retaining a striker in use, and a pawl having a retaining position for retaining the latch bolt in at least its closed position, and a release position for allowing the latch bolt to move between its open and closed positions, a release element having a rest position and an actuated position, a release link having an engaging position and a disengaged position, movement of the release element between its rest position and its activated position causing movement of the release link, movement of the release element from the rest position to the actuated position when the release link is in its engaging position causing the pawl to move to its release position, and movement of the release element from the rest position to the actuated position when the release link is in its disengaged position allowing the pawl to remain in its retaining position, and a locking member having a locked position, wherein the release link is held in its disengaged position and an unlocked position allowing the release link to move to its engaging position, characterised in that a biasing means is provided which provides a bias action force and a bias reaction force, the action force acting to bias the release link towards its engaging position and the bias reaction force acting to bias the latch bolt towards its open position.

In that way, a single biasing means can act to bias both the release link and the latch bolt. The biasing means is preferably a spring. In one form the spring is a torsion spring, most preferably having two arms.

In one embodiment of the invention, a first arm act on the latch bolt and a second arm acts on the release link. An abutment surface is preferably provided on the latch bolt against which the first arm acts. Preferably the release link has a transverse arm upon which the biasing means acts. Such an arrangement gives rise to a turning moment on the release link. Preferably one or more of the latch bolt, pawl, release element, release link and locking lever are pivotally mounted. Preferably the latch bolt and the release element share a first common pivot. Preferably the spring body is mounted on the first common pivot. With the axis of the spring body fixed, the forces through the arms tend toward equalisation. Preferably the transverse arm is fixed to the second arm of the spring. Preferably the release element and the release link share a second common pivot. Preferably the bias action force acts between the first common pivot and the second common pivot.

According to a further aspect of the invention there is provided a motor vehicle having a latch mechanism in accordance with the first aspect of the invention or any of the consistory clauses relating thereto.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
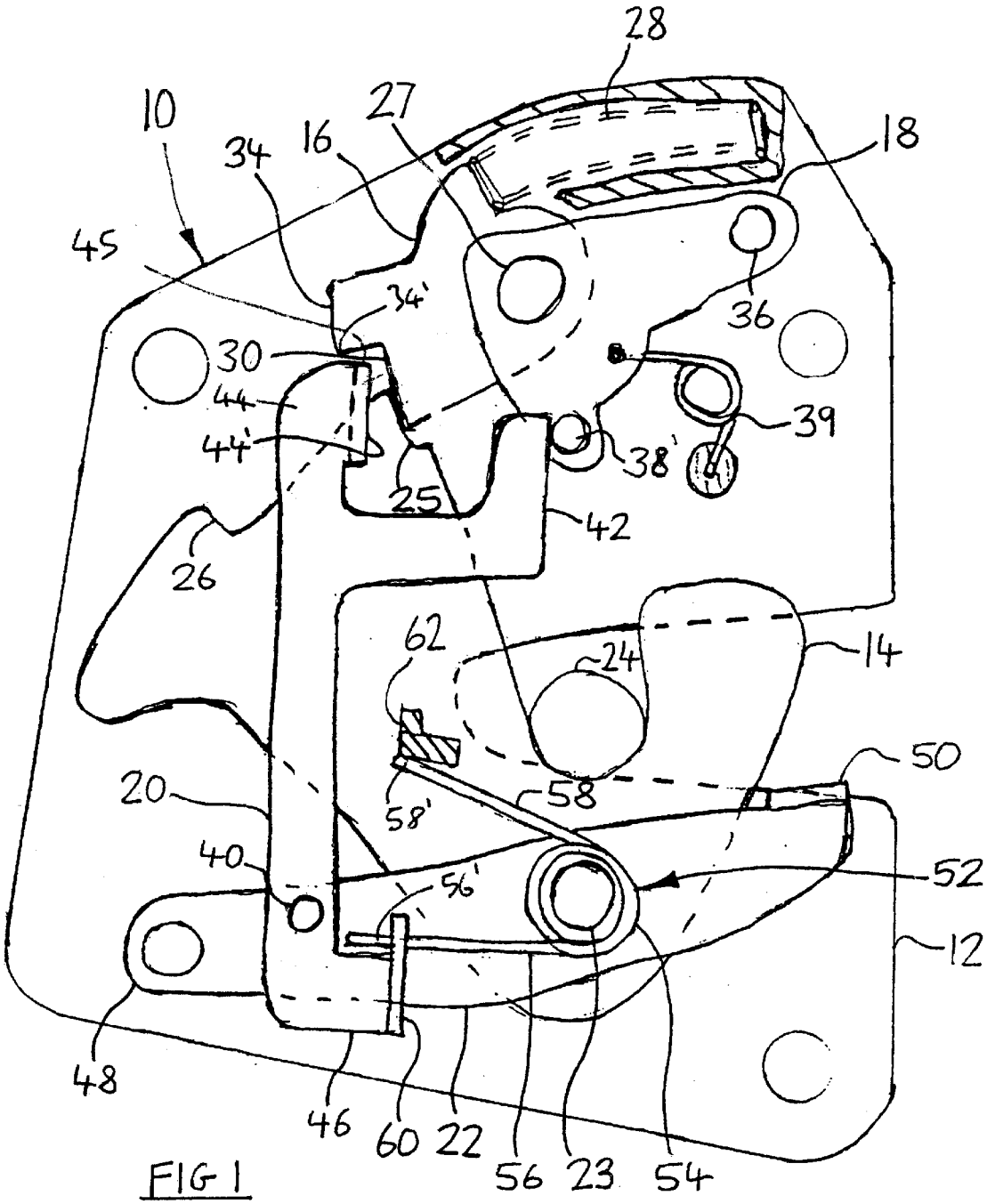
FIG. 1 shows a side view of a latch mechanism in accordance with the invention.

Referring to FIG. 1, the latch mechanism 10 comprises a housing plate 12, upon which a latch bolt 14, a pawl 16, a locking element in the form of a locking lever 18, and release lever 22 are mounted. A release link 20 is mounted on the release lever 22.

The latch bolt 14 is rotatably mounted on a pivot 23 and comprises a first abutment surface 25 and a second abutment surface 26. The bolt 14 is adapted to receive and capture a striker 24 on a vehicle.

The pawl 16 is rotatably mounted on a pivot 27 and is biased by a pawl spring 28 into the position shown in FIG. 1. The pawl 16 has a retaining surface 30 retaining the latch bolt 14 in at least a closed position, and a lug 34.

The locking lever 18 is also mounted on pivot 27, independently of the pawl 16.

The locking lever 18 has a projection 36 which is adapted to be acted upon by a locking actuator. The locking lever 18 has a lug 38 including a pin 38'. An over center spring 39 acts to maintain the locking lever 18 in either of a locked and an unlocked position.

The release link 20 is pivotally connected at pivot 40 to the release lever 22, which in turn is pivotally mounted, independently of the latch bolt 14, at the pivot 23.

The release link 20 has a first arm 42, adapted to abut against the pin 38' and a second arm 44, substantially parallel to the first arm 42. Second arm 44 includes a tab 44' having an upper abutment surface 45. The release link 20 has a transverse arm 46 directed towards the pivot 23 proximal pivot 40. In the embodiment shown, the transverse arm 46 is perpendicular to the axis of linear movement of the release link 20.

The release lever 22 comprises a first end 48 and a second end 50 which are activatable by an outer door handle and an inner door handle, respectively, in known manner to move the release link.

The latch mechanism 10 further comprises a biasing means 52 in form of a spring 52. Spring 52 is a torsion-type spring consisting of a spring coil body 54 with first and second spring arms 56, 58, respectively. The spring arms 56, 58 are spaced apart, preferably at an angle of 30° to 45°, so as to confer a U shape to the spring 52.

End 58' of second spring arm 58 contacts an abutment 62 secured rotationally fast on latch bolt 14 and acts to bias latch bolt 14 inwards into its open condition, i.e. in a clockwise direction when viewing FIG. 1.

End 56' of first spring arm 56 abuts bent tab 60 of transverse arm 46. Thus arm 56 tends to bias release link 20 in a clockwise direction about pivot 40. It should be noted that the contact between arm 56 and tab 60 is situated substantially between pivots 23 and 40.

It will be appreciated that the spring 52 provides a bias action force and a bias reaction force. The bias reaction force acts to bias the latch bolt 14 towards its open position and the bias action force acts to bias the release link 20 towards its engaging position.

With the latch mechanism 10 position as shown in FIG. 1 the release link 20 is biased in a clockwise direction such that arm 42 abuts pin 38'. In this position upper abutment surface 45 aligns with lug 34 of pawl 16. Operation of the release lever 22 in a clockwise direction from the position as shown in FIG. 1 causes the release link 20 to move in an upward direction such that upper abutment surface 45 contacts lug 34 causing pawl 16 to rotate in a clockwise direction which results in retaining surface 30 of the pawl 16 disengaging the first abutment surface 25 of the latch bolt 14, allowing the latch bolt to move to an open position. When the release lever 22 is returned to the position as shown in FIG. 1 the pawl 16 also returns to the position as shown in FIG. 1 and subsequent closing of the door will cause the latch bolt 14 to rotate and be retained by pawl 16.

Figure 2:
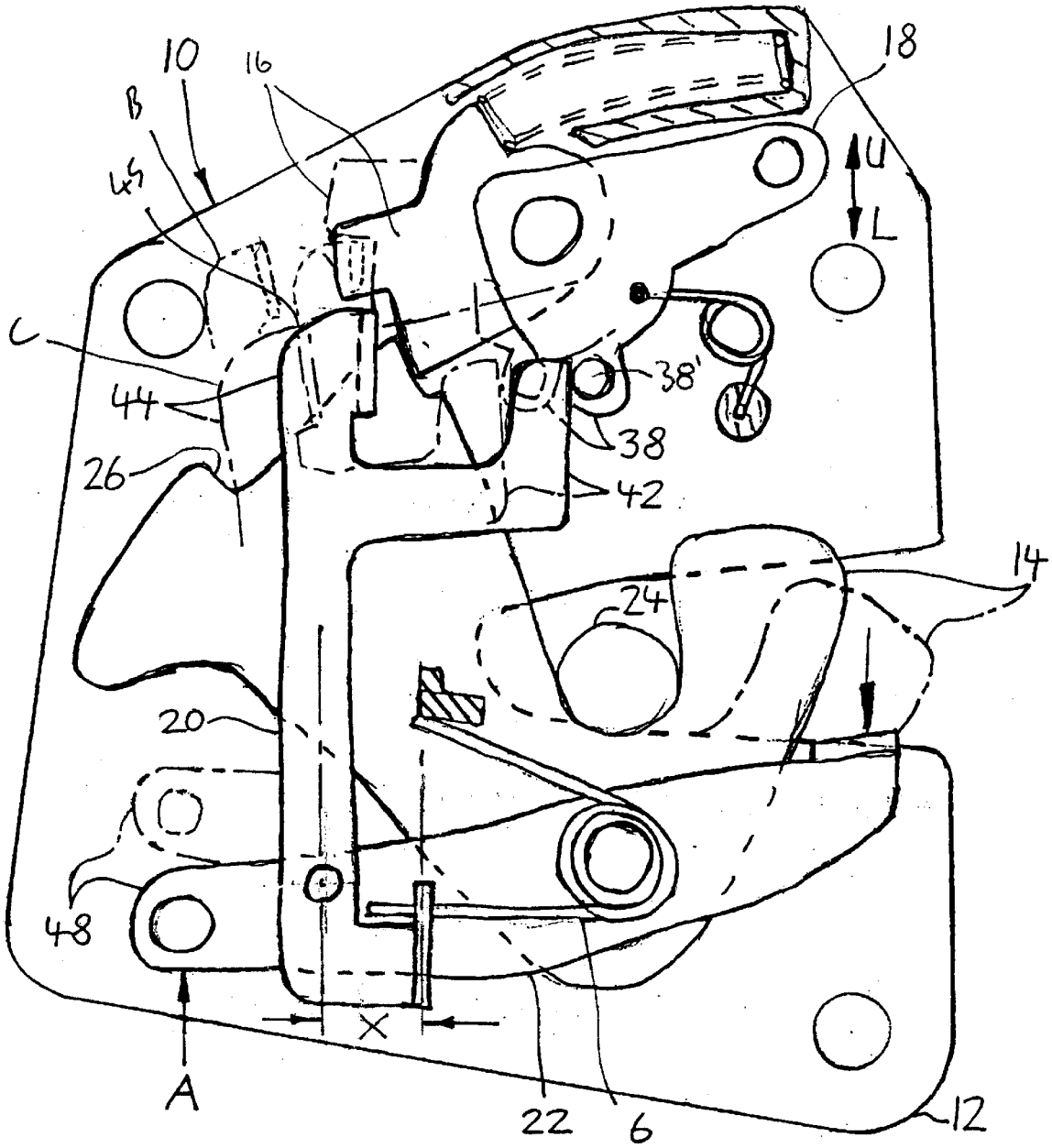
FIG. 2 shows a similar view of the latch mechanism of FIG. 1 showing various positions of the components of the latch mechanism in use.

The latch mechanism 10 can be moved to a locked condition by rotation of locking lever 18 clockwise such that pin 38' causes release link 20 to pivot counter-clockwise about pivot 40 to the chain dotted position C as shown in FIG. 2. Under these circumstances the upper abutment surface 45 is no longer aligned with lug 34 and thus subsequent actuation of the release lever 22 causes the upper abutment surface 45 to move past and miss a lower abutment surface 34' of the lug 34. Thus under these circumstances the latch bolt 14 cannot be opened.

In particular, with the latch bolt 14 in the locked condition and with the release lever 22 actuated, the release link 20 is positioned at position B of the FIG. 2. If the locking lever 18 is moved to the unlocked position, the release link 20 rotates in a clockwise direction about pivot 40 until such time as surface 44' abuts the end of lug 34. Subsequent release of the release lever 22 causes the surface 44' to slide across lug 34 and because the release link 20 is being biased in a clockwise direction by spring 52, once the upper abutment surface 45 passes the edge 34' of the lug 34, the release link 20 further rotates clockwise such that the upper abutment surface 45 aligns with the lug 34.

Thus, under the circumstances, releasing of an outside handle moves the latch mechanism 10 into its unlocked condition and as such it can be seen that the latch mechanism is provided with a "panic unlocking" feature.

It would be appreciated that in further embodiments other forms of bias means could be used in place of spring 52.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A latch mechanism comprising:

a latch bolt having an open position for releasing a striker in use, and a closed position for retaining a striker in use;

a pawl having a retaining position for retaining said latch bolt in at least said closed position, and a release position for allowing said latch bolt to move between said open and closed positions;

a release element having a rest position and an actuated position;

a release link having an engaging position and a disengaged position, movement of said release element between said rest position and said actuated position causing movement of said release link, movement of said release element from said rest position to said actuated position when said release link is in said engaging position causing said pawl to move to said release position, and movement of said release element from said rest position to said actuated position when said release link is in said disengaged position allowing said pawl to remain in said retaining position;

a locking member having a locked position, wherein said release link is held in said disengaged position and an unlocked position allowing said release link to move to said engaging position; and a biasing member providing a bias action force and a bias reaction force, said action force acting to bias said release link towards said engaging position and said bias reaction force acting to bias said latch bolt towards said open position.

2. The latch mechanism as recited in claim 1 wherein said biasing member is a spring.

3. The latch mechanism as recited in claim 2 wherein said spring is of a torsion type.

4. The latch mechanism as recited in claim 3 wherein said spring has two arms.

5. The latch mechanism as recited in claim 4 wherein a first arm which acts on said latch bolt and a second arm which acts on said release link.

6. The latch mechanism as recited in claim 5 wherein an abutment surface is provided on said latch bolt against which said first arm acts.

7. The latch mechanism as recited in claim 1 wherein said release link has a transverse arm upon which said biasing member acts.

8. The latch mechanism as recited in claim 7 wherein said transverse arm has a tab upon which said biasing member acts.

9. The latch mechanism as recited in claim 1 wherein at least one of said latch bolt, said pawl, said release element, said release link and said locking member are pivotally mounted.

10. The latch mechanism as recited in claim 9 wherein said latch bolt and said release element share a first common pivot.

11. The latch mechanism as recited in claim 2 wherein a body of said spring is mounted on a first common point.

12. The latch mechanism as recited in claim 1 wherein said release element and said release link share a second common pivot.

13. A motor vehicle comprising:

a vehicle door; and a latch mechanism utilized on said vehicle door including a latch bolt having an open position for releasing a striker in use, and a closed position for retaining a striker in use, a pawl having a retaining position for retaining said latch bolt in at least said closed position, and a release position for allowing said latch bolt to move between said open and closed positions, a release element having a rest position and an actuated position, a release link having an engaging position and a disengaged position, movement of said release element between said rest position and said actuated position causing movement of said release link, movement of said release element from said rest position to said actuated position when said release link is in said engaging position causing said pawl to move to said release position, and movement of said release element from said rest position to said actuated position when said release link is in said disengaged position allowing said pawl to remain in said retaining position, a locking member having a locked position, wherein said release link is held in said disengaged position and an unlocked position allowing said release link to move to said engaging position, and a biasing member providing a bias action force and a bias reaction force, said action force acting to bias said release link towards said engaging position and said bias reaction force acting to bias said latch bolt towards said open position.

* * * * *